United States Patent [19]

Forterre

[11] Patent Number: 4,808,949

[45] Date of Patent: Feb. 28, 1989

[54] INTEGRATED HYPERFREQUENCY CIRCULATOR

[75] Inventor: Gérard Forterre, Colombes, France

[73] Assignee: Thomson Hybrides et Microondes, Paris, France

[21] Appl. No.: 153,915

[22] Filed: Feb. 9, 1988

[30] Foreign Application Priority Data

Feb. 13, 1987 [FR] France ..... 87 01865

[51] Int. Cl.[4] ..... H01P 1/39

[52] U.S. Cl. ..... 333/1.1; 333/24.1

[58] Field of Search ..... 333/1.1, 24.1, 24.2

[56] References Cited

U.S. PATENT DOCUMENTS 3,466,571 9/1969 Jansen et al. ..... 333/1.1
3,684,983 8/1972 Cotter et al. ..... 333/1.1
3,866,150 2/1975 Thai et al. ..... 333/1.1
4,145,672 3/1979 Piotrowski ..... 333/1.1
4,254,384 3/1981 Piotrowski et al. ..... 333/1.1
4,280,111 7/1981 Forterre ..... 333/1.1

*Primary Examiner*—Paul Gensler
*Attorney, Agent, or Firm*—Oblon, Fisher, Spivak, McClelland & Maier

[57] ABSTRACT

A hyperfrequency circulator is provided in which the gyrator is integrated in the wave-guide, comprising a wave-guide whose two main faces are pierced with two holes, aligned with the center of symmetry of the junction. Through these holes a one-piece gyrator passes formed by at least one magnet, a pole piece, a solid dielectric resonator and a second pole piece. The gyrator is cylindrical in shape, and the pole pieces each have a flange of the same diameter as the holes in the wave-guide, the cooling plates immobilizing the one piece gyrator in the wave-guide.

9 Claims, 2 Drawing Sheets

INTEGRATED HYPERFREQUENCY CIRCULATOR

BACKGROUND OF THE INVENTION

The present invention relates to a wave-guide circulator, for hyperfrequency waves, in which the gyrator may be integrated. The circulator of the invention is a model in which the power may reach and even exceed a kilowatt, in a frequency range between 1 and 100 GHz.

In its general definition, a circulator is a hyperfrequency component with a certain number of ports, three at least, which transmits the energy which it receives through one port to another port. This component has the property of non reciprocity, that is to say that if the direction of the incident energy is modified, the function of the input and output ports is not exchanged. This condition of non reciprocity is introduced by using in such component a gyrator comprising ferrites. These latter ceramic magnetic materials formed mainly by metal oxides which differ however from conventional metal magnetic materials by the fact that they are non conducting and have low losses of magnetic origin at hyperfrequencies.

Among the different classes of circulators, those said to be with junction consist of a junction with three or four ports formed as a wave guide in which there is inserted, at the center thereof, at least one ferrite bar subjected to an external transverse magnetic field.

Wave-guide circulators are formed of a metal body which is either integrally machined in the mass, or is welded, and whose body is:

- either in several assembled parts: it is then easy to adhere thereto and position the ferrites,
- or in a single piece, which means that access cannot be had to the inside of the body, for fixing a gyrator there except through the ports of the circulator, which involves then removal thereof from the equipment in which it is in service.

Wave-guides are made either from welded metal sheet, or are molded and it is difficult to accurately position therein and fix therein the ferrite part or parts of the gyrator, all the more so since wave-guides do not have—except for the ports—slits or air gaps which have the double drawback of having a high impedance and of causing a hyperfrequency leak, which is dangerous for the user.

It is then an object of the invention to solve the problem of integrating a gyrator in a wave-guide structure, without requiring access to the inside of the wave-guide.

It is another object of the invention to solve this problem in the case of a one-piece wave-guide, welded or molded, but formed to two separable half shells.

It is a further object of the invention to solve this problem in the case of high power circulators, having on their main surfaces air or liquid heat sinks.

It is also an object of the invention to provide an industrial power circulator insensitive to dust, through the absence of free gaps between the ferrite.

Finally it is an object of the invention to provide ready and economic integration of the gyrator in the circulator without additional insertion losses or parasite radiation.

SUMMARY OF THE INVENTION

According to the invention, the circulator is formed with two circular facing holes, in its two parallel walls, and at the position where the gyrator is to be located. The gyrator is in one-piece and is formed by stacking cylindrical shaped parts which are bonded together. Ths gyrator comprises, at least, a pole piece, a ferrite, a solid dielectric such as silica, a ferrite and a second pole piece. One or two magnets may also be bonded to the two pole pieces. All the components of the gyrator have substantially the same diameter, so that the gyrator is in the form of a cylindrical piece which can be inserted through the holes formed in the circulator. Only the pole pieces have, at a level corresponding to the main walls of the wave-guide a projecting flange of a greater diameter, but equal to the diameter of the holes in the wave-guide: the two heat sinks, which are also pierced with holes corresponding to the passage of the gyrator, lock this latter in position, by bearing on the external faces of the flanges of the pole pieces. The gyrator is therefore fixed through the heat sinks. A special bonded seal or "hyperfrequency" seal does away with any hyperfrequency radiation leak, and provides thermal continuity for cooling of the gyrator.

More precisely, the invention provides an integrated hyperfrequency circulator, comprising a wave-guide junction and a gyrator placed at the center of symmetry of the junction, as well as cooling plates applied to the main faces of the wave-guide, this circulator being characterized in that:

- the two main faces of the wave-guide are pierced with holes, one facing the other, and centered on the center of symmetry of the junction,
- a one-piece gyrator passes through the wave-guide, through holes formed in the main faces of the wave-guide,
- the cooling plates hold the gyrator immobile in the wave-guide.

BRIEF DESCRIPTION OF THE DRAWINGS

The invention will be better understood and other features will be clear from reading the following description, with reference to the accompanying Figs. in which.

DESCRIPTION OF THE PREFERRED EMBODIMENTS

Figure 1:
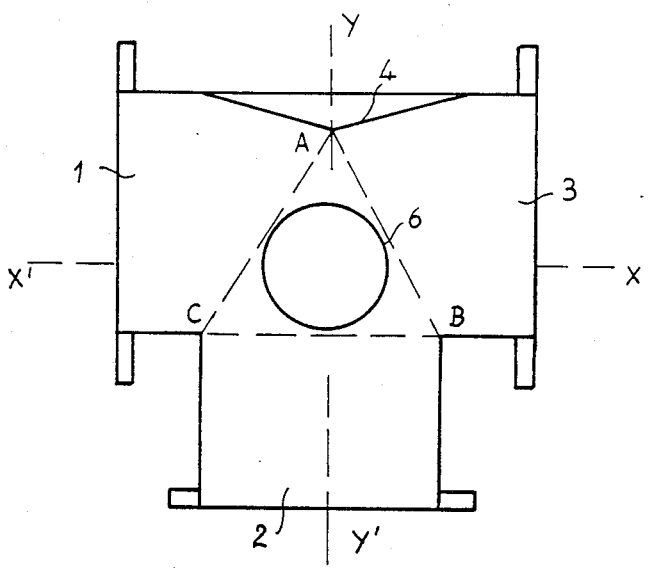
FIG 1 PRIOR ART
FIG. 1 is a simplified top view of a circulator of the prior art.
Figure 2:
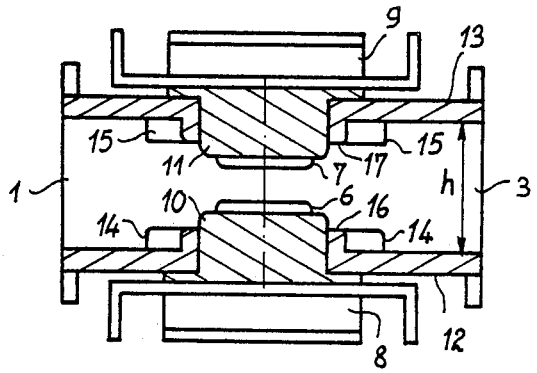
FIG 2 PRIOR ART
FIG. 2 is an example of fitting a gyrator in a circulator, in accordance with the prior art.
Figure 3:
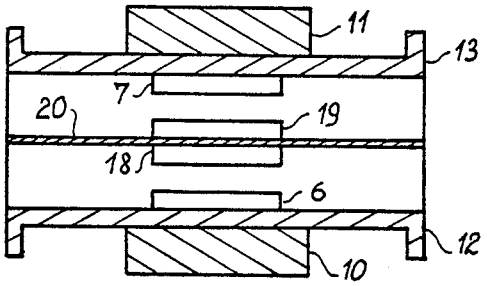
FIG 3 PRIOR ART
FIG. 3 is another example of fitting a gyrator in a circulator in accordance with the known art.

FIGS. 1 to 3 define what a circulator is and how a gyrator can be integrated therein, but this preliminary reminder will simplify the following explanations and will make the description of the invention clear.

FIG. 1 gives the plan view of a circulator with three ports made from a T or Y junction and three arms formed by wave-guides whose apertures are called ports 1, 2, 3. A setp 4 ensures the ternary symmetry of the junction, so that the triangle ABC, formed between the common point to the three wave-guides, in the plane of the FIG. is an equilateral triangle. In the axis of this junction, i.e. in the axis of the center of triangle ABC, are placed two ferrite disks 6 and 7 subjected to a transverse magnetic field applied by one or two magnets 8 and 9, through pole pieces 10 and 11.

With FIG. 1 being a plan view which passes through the plane of symmetry of the circulator, FIG. 2, which is a section along X'X, shows the parts not shown in FIG. 1. We will call the main faces of the circulator faces 12 and 13 which are flat and parallel to the plane of symmetry of the circulator.

In such a circulator, the hyperfrequency energy entering through port 1 leaves through port 3 and the energy entering through port 3 leaves through port 2.

A circulator formed in the way described above does not however function correctly for it is not matched. So that the conditions of circulation in the circulator are satisfied, the impedance of the wave-guides must be reduced at the level of the ferrites. The rectangular wave-guides which are currently used are standardized wave-guides and in which the ratio of the sides is of the order of two to one and which propagate the mode TE10. To reduce the impedance of the wave-guides it is necessary to reduce the height "h" thereof. This reduction is achieved by introducing into the junction metal plates 14 and 15 forming an impedance transformer. These plates are disposed against the main faces of the junction and the ferrite disks 6 and 7 are bonded facing each other against these plates. It is obvious that the necessary insertion of these plates reduces the distance separating the ferrite disks and increases correspondingly the risks of breakdown at this level. The power resistance of a junction circulator of the prior art is therefore limited, thus resulting in a considerable limitation in the use thereof.

FIG. 2 shows how the elements which have just been described are positioned and held in position.

In U.S. Pat. No. 4,280,111 belonging to the application, the main faces 12 and 13 of the wave-guide are each formed with a hole edged by a shoulder 16 and 17 on which the impedance transformer 14 and 15 is brazed. In each hole there penetrates an assembly formed by a ferrite 6, a pole piece 10 a heat sink and a magnet 8, all which pieces are brazed together, the assembly being additionally brazed to shoulder 16.

This type of mounting two assemblies which are independent and separated by an air dielectric requires:

- shoulders 16 and 17 for correctly positioning each assembly of brazed parts,
- impedance transformers 14 and 15.
- very accurate dimensions so that the necessary distance between the ferrite disks 6 and 7 is respected,
- that the circulator, once mounted, should not be dismantled.

In fact, this type of mounting requires access to the inside of the wave-guide for brazing for example. This is a disadvantage with respect to power wave-guides which are made in one-piece from a molded metal.

But, in addition, it is also known that decoupling between the ports of a circulator decreases when the power of the incident wave exceeds a threshold which depends on the choice of the ferrite, on the frequency of the wave and on the way in which the circulator is formed, and that, for a high power in a circulator whose ferrite disks are separated by a given distance, there is a risk of breakdown, which the presence of the dielectric eliminate.

U.S. Pat. No. 3,866,150 brings a solution to the increase of power in a junction circulator. FIG. 3, which recalls the basic notion thereof, is simplified and limited to the parts required for understanding: a power circulator in this case is in the form of two low impedance junction circulators, connected electrically in series.

In a circulator with main faces 12 and 13, a metal plate 20 is inserted at the height of the longitudinal plane of symmetry, which results in dividing the junction as well as the standardized wave-guides into two junctions and associated guides of reduced height. This plate occupies the whole area of the junction. However, it may extend beyond and occupy both the area of the junction and of the arms.

From the preceding remark two junctions are thus obtained in the form of reduced impedance guides with which two circulators are formed by placing, in the access of the junctions on each side of wall 20, two ferrite disks 18 and 19 which are thus located respectively opposite disks 6 and 7. Thus two circulators are obtained which are stacked, that is to say that electrically they are connected in series. They can be readily matched without any metal element for reducing the impedance, since they are already formed in low impedance guides. Since each of these circulators only receives half of the incident energy, the total admissible power in the circulator obtained by stacking the two elementary circulators together is practically twice that of a normal circulator.

This type of mounting requires tools for mounting the ferrite 6, 7, 18 and 19 with respect to the pole pieces 10 and 11.

Figure 4:
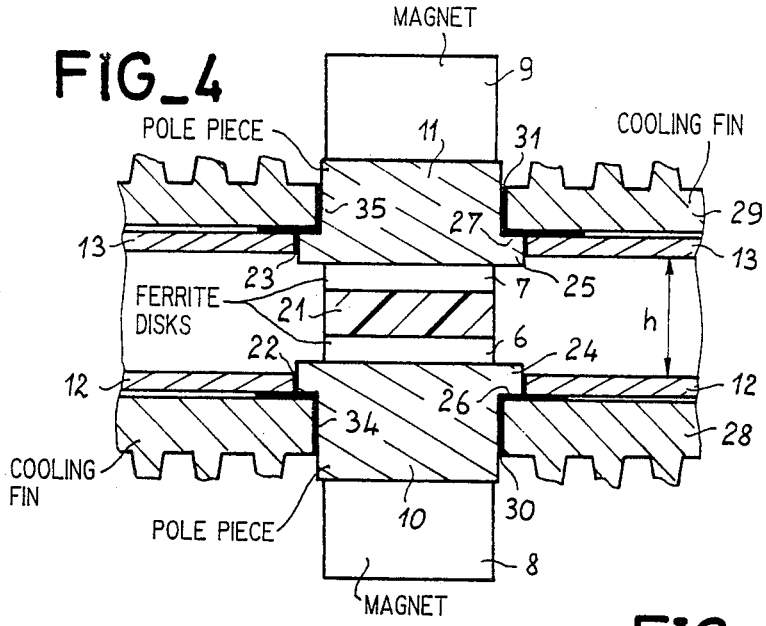
FIG. 4 is a sectional view of the part of a circulator in which is mounted a gyrator according to the invention (partial view), with a first type of seal.

The drawbacks of the prior art are avoided by the structure of the circulator of the invention, a partial view of which, that of the region of the gyrator, is shown in section in FIG. 4. To facilitate understanding, the same references are kept if they designate the same objects.

In a circulator whose general forms are those of FIG. 1, the junction with ternary symmetry is formed by a wave-guide of reduced height, the ratio of reduction with respect to standard wave-guides depending on the frequency and on the power which passes through. Coupling of the hyperfrequency waves to the gyrator takes place directly, without any impedance transformer. That is to say that the main faces 12 and 13 of the wave guide are flat, inside the cavity, and that no impedance transformer, such as 14–15 in FIG. 2, is brazed or molded thereto.

The main faces 12 and 13 each comprise, in line with the ternary center of symmetry, a circular hole 22 and 23.

The one-piece integratable gyrator is an assembly with cylindrical external shape, formed by:

- a composite one-piece resonator comprising two ferrite disks 6 and 7 bonded to the two faces of a dielectric disk 21, such as silica or ceramic,
- two pole pieces 10 and 11 made from soft steel, whose cylindrical shape adapted to the functions to be fulfilled will be analyzed subsequently, one or two cylindrical magnets 8 and 9 of a diameter less than that of the pole pieces.

The assembly of these pieces is bonded, so as to form a one-piece gyrator which can be handled and inserted through the facing holes 22 and 23.

They all have a diameter which is substantially constant, except the two pole pieces 10 and 11 which have at their base, that is to say at the level where they pass through the main faces 12 and 13, a projecting flange 24 and 25, of a diameter equal to the diameter of holes 22 and 23 in faces 12 and 13 of the wave-guide. Flanges 24 and 25 have a flat face external—with respect to the wave-guide—26 and 27 coplanar with the external surface of faces 12 and 13 of the wave-guide.

Two joints sealed to the hyperfrequency energy—which will be described in greater detail subsequently—are inserted between the one-piece gyrator and the wave-guide.

Figure 7:
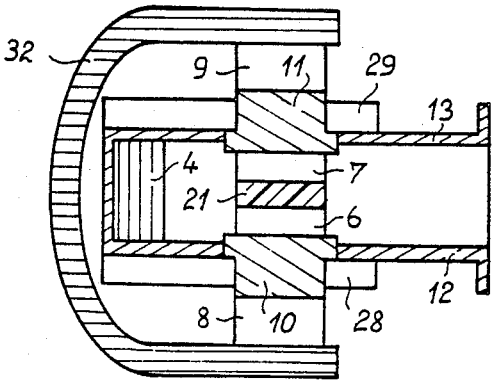
FIG. 7 is a sectional view of a gyrator of the invention (overall view).

Finally, the power circulator of the invention comprises cooling means formed either by two air cooled finned plates 28 and 29 such as shown in FIG. 4 or by two liquid flow boxes, such as shown in FIG. 7. These cooling means are also formed with two holes 30 and 31, of a diameter corresponding to the small diameter of the pole piece 10 and 11.

With the one-piece gyrator positioned in holes 22 and 23 of the wave-guide, the fact of fixing the cooling plates 28 and 29 immobilizes the gyrator, because the internal faces, turned towards the wave-guide of plates 28 and 29, bear on the external faces 26 and 27 of the flanges of the pole pieces 10 and 11 and lock the gyrator.

A circuit made from a soft magnetic material 32, having one or more removable parts, or else forming a partially open return circuit for the magnetic flux, completes the power circulator of the invention. This magnetic circuit 32 is shown in FIG. 7, which gives a view—along axis Y'Y of FIG. 1—which is more general but less detailed than FIG. 4.

The structure of the circulator of the invention is such that each of the parts, which will now be described in greater detail, and the complete gyrator can be checked before integrating them.

Contrary to known solutions in the form of a wave-guide structure and more specially those for power applications, the one-piece resonator is formed without an air gap between the ferrites 6 and 7, the air gap being replaced by a dielectric or a metal plate 20. It is mainly formed by at least two thin ferrites, either in the form of disks or with a section having a ternary symmetry. By thin ferrites is meant ferrites of small thickness with respect to the wave length in the composite resonator.

The dimensions of the ferrites and of the dielectric are calculated so as to obtain a gyro magnetic resonator whose impedance is practically the same as that of the wave-guide of reduced height forming the accesses to the junction.

Such a structure avoids the intrusion of dust or the condensation of material in the critical zone situated between the ferrites.

It is then the dimensions calculated for the ferrites which determine the diameter of the projecting flanges 24 and 25 of pole piece 10 and 11 and, consequently, the diameter of holes 22 and 23 in main faces 12 and 13 of the wave-guide.

The cylindrical pole pieces 10 and 11, made from soft steel or the like, have a small diameter at the height of the cooling plates 28 and 29 and a large diameter, that of the projecting flange 24 and 25, at the height of faces 12 and 13 of the wave-guide. They may without disadvantage penetrate inside the wave-guide, through the total thickness of the one-piece resonator 6+21+7. The important thing is that the distance which separates the two faces 26 and 27 of the flanges be equal to the distance between the two external faces of walls 12 and 13 of the wave guide.

Their shapes make simultaneously possible:

the insertion of the mounted and previously tested gyrator in the compact hyperfrequency structure, where only one central calibrated hole is formed at the position where the gyrator is to be incorporated, after insertion of the gyrator, ready fitting of the seals and of the cooling plates, the formation of a low resistance thermal interface.

This latter may be formed by a conducting film of bonding agent or lacquer 34 and 35 between the cylindrical surfaces of pole pieces 10 and 11, and the internal surfaces of holes 22 and 23 in the wave-guide, and 30 and 31 in the heat sinks. This film does not have to provide a rigid mechanical connection.

The diameter of pole pieces 10 and 11 at the level of the insertion zone in the wave-guide junction, must be as close as possible to that of ferrites 6 and 7 so as to reduce the rate of energy coupled through the gap inevitably existing between these pole pieces and the metal body of the junction, the coupling thus provided being of magnetic type in a region where the magnetic fields do not have transverse components.

It is to avoid high precision machining of holes 22 and 23 and flanges 24 and 25 that the invention provides hyperfrequency sealing bonding, and because the air gaps have a very high impedance.

Figure 5:
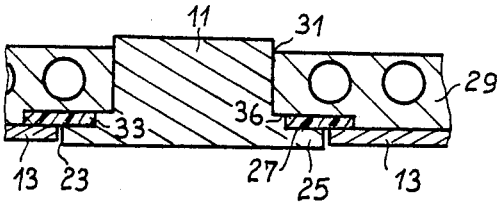
FIG. 5 is a sectional view of the fitting of the gyrator, in accordance with the invention (partial view), with a second type of seal.

FIG. 5—which only shows a part of FIG. 4—illustrates another hyperfrequency sealing system, without conducting bonding agent or lacquer. In this case, hole 31 in cooling plate 29 has a diameter such that plate 29 is shrunk fit on the body of pole piece 11. There is then mechanical fixing of the one-piece gyrator by means of the cooling plate 29, and there is no hyperfrequency leak because of the shrink fit. However, a special hyperfrequency absorbant seal 33 is disposed about the pole piece 11 and between plate 29, on the one hand, and flange 25 and face 13, on the other. In this case, plate 29 is machined so as to create therein a housing for seal 33, and a second projecting flange 36, about the pole piece 11, facilitates the centering of seal 33.

The cooling means 28 and 29 comprise at least one flat plate in close contact with the external surfaces of faces 12 and 13 of the wave-guide. They are of a width greater than the width of the wave-guide, so that they project therefrom. These plates, once secured together, for example by screws which do not pass through the wave-guide, ensure the mechanical rigidity of the gyrator, in the structure which receives it and participate in the provision of the hyperfrequency seals.

Plates 28 and 29 may comprise fins, as shown in FIG. 4, or tubes allowing a fluid to flow, such as shown in FIG. 5, or else formed of "water boxes" as shown in FIG. 7. The cooling fluid may further flow through tubes welded to these plates.

Magnets 8 and 9 may be made from ferrite, or from other materials such as samarium-cobalt. They may be bonded to the one-piece gyrator, but they may also be positioned by means of the cooling plates 28 and 29 and held in position by the magnetic circuit 32.

It has been mentioned that the circulator of the invention comprises a wave-guide of very reduced height, so of an impedance matched to that of the gyrator. But, as is known in this case, the power which may pass through the circulator is less than if the wave-guide were of a greater height.

If a high power is required, it is possible to apply to the invention the structure described in FIG. 3 and which depends on the U.S. Pat. No. 3,866,150 already mentioned. The gyrator is then that shown in FIG. 6.

It is still a one-piece cylinder, but the resonator comprises, between the ferrites 6 and 7 and the dielectric 21 already described, at least a third ferrite 37 (which may have two parts provided on opposite sides of a metal plate 20, as discussed below), a second dielectric 38, which means that the circulator of great height functions like two circulators of small height mounted in parallel. Such a resonator is mounted without a metal plate 20 (see FIG. 3) being mounted in the wave-guide.

Figure 6:
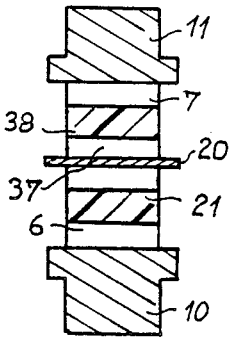
FIG. 6 is a sectional view of a gyrator of the invention, improved so as to increase the controlled power.

However, a metal plate 20 may be mounted in the median plane of a wave-guide, in accordance with U.S. Pat. No. 3,866,150. In this case, the gyrator:

either passes through a hole formed in plate so that the third ferrite is a one part ferrite, or as shown in FIG. 6 is divided into two halves, each being in a single piece (10 or 11) and comprises a pole piece, a first ferrite (6 or 7), a dielectric (21 or 38) and a second ferrite, (separate parts of ferrite 37 shown in FIG. 6), plate 20 not being pierced.

The circulator of the invention has been described as a power circulator: the models constructed convey 1 kilowatt at 2.45 GHz. However, the structure of the invention applies to low power circulators. In this case, it may comprise only a single magnet and the pole piece without magnet either bears on the main unpierced face of the wave-guide or is blocked by the cooling plate.

The applications of the circulator of the invention are numerous. In the power field, they relate to industrial heating, such as the drying of paper or inks, polymerization, . . . In the single processing field, the circulator may be integrated in a hyperfrequency head up to very high frequencies (to 94 GHz, for example).

The scope of the invention is made clear in the following claims.

What is claimed is:

1. An integrated hyperfrequency wave-guide circulator having wave-guide junction, a gyrator placed at a center of symmetry of the wave-guide junction, and cooling plates applied to a pair of main faces of the wave-guide junction, said circulator comprising:

the pair of main faces of the wave-guide junction provided with mounting through holes, one facing the other, said holes located at the center of symmetry of the wave-guide junction;

said gyrator passing through the wave-guide junction through said through holes formed in the main faces of said wave-guide junction, said gyrator comprising at least one magnet, a first pole piece adjacent said magnet, a first ferrite adjacent said first pole piece, a second ferrite, at least a first a solid dielectric interposed between said first and second ferrites, and a second pole piece adjacent said second ferrite, wherein each of the pole pieces of the gyrator comprises a projecting flange having a diameter larger than a remaining cylindrical portion of the gyrator located between the flanges of said pole pieces, each flange having one face which is external with respect to the wave-guide junction and coplanar with the external surface of a respective main face of the wave-guide junction; and said cooling plates abutting against the external faces of said flanges of said pole pieces thereby to hold the gyrator immobile in the wave-guide junction.

2. The circulator as claimd in claim 1, wherein the wave-guide junction has a height matched to the impedance of the gyrator and its main faces are flat inside the wave-guide junction, said wave-guide junction comprising no impedance matching parts.

3. The circulator as claimed in claim 1 wherein with the exception of said flanges, the gyrator has substantially uniform diameter, which is determined by calculation of the resonator formed by the ferrites and the solid dielectric as a function of the frequency at which the circulator operates and of the power which passes through it.

4. The circulator as claimed in claim 1, wherein the holes in the main faces of the wave-guide junction have a diameter equal to the diameter of the projecting flanges of the pole pieces.

5. The circulator as claimed in claim 4, wherein each cooling plate has a hole, in the access of the gyrator and of the same diameter as the pole pieces, and a conducting seal, interposed between the pole pieces and the main faces of the wave-guide as well as the cooling plates, provides sealing to the hyperfrequency waves at a thermal continuity between the gyrator and the cooling plates.

6. The circulator as claimed in claim 4, wherein each cooling plate is provided with a hole, in the access of the gyrator and of the same diameter as the pole pieces, and at least one cooling plate is shrunk fit on a pole piece, a flat seal sealing to the hyperfrequency energy being placed between the cooling plate and the upper face of the projecting flange of said pole piece.

7. The circulator as claimed in claim 1, wherein, in a high power model, the gyrator comprises: at least two resonators connected in series, including a first resonator comprising said first pole piece, said first ferrite, said first dielectric, and a third ferrite, and a second resonator comprising said second pole piece, said second ferrite, a second dielectric, and a fourth ferrite, wherein the third ferrite of said first resonator and the fourth ferrite of said second resonator are positioned in opposing relationship.

8. The circulator as claimed in claim 7, wherein said third and fourth ferrites are integrally formed parts of a single ferrite element.

9. The circulator as claimed in claim 7, wherein said gyrator comprises a metal plate located in a median plane of the wave-guide and separating said third and fourth ferrites of said first and second resonators.

* * * * *